United States Patent [19]

Ferguson

[11] 4,396,030

[45] Aug. 2, 1983

[54] CAR TOP FOLDING TENT

[75] Inventor: Robert W. Ferguson, Ann Arbor, Mich.

[73] Assignee: The Oyster Tent Company, Ann Arbor, Mich.

[21] Appl. No.: 340,124

[22] Filed: Jan. 18, 1982

[51] Int. Cl.[3] ..... A45F 1/00

[52] U.S. Cl. ..... 135/88; 182/214; 182/93; 296/161

[58] Field of Search ..... 135/88, 89; 296/160-163, 159; 182/93, 106, 107, 111, 214

[56] References Cited

U.S. PATENT DOCUMENTS

| | | | |
|---|---|---|---|
| 2,187,633 | 1/1940 | Smith | 182/106 |
| 2,930,051 | 3/1960 | Kampmeier | 296/161 |
| 3,712,316 | 1/1973 | Leonard | 135/88 |

*Primary Examiner*—Richard C. Pinkham
*Assistant Examiner*—Stephen R. Crow
*Attorney, Agent, or Firm*—Stephenson and Boller

[57] ABSTRACT

A folding tent assembly adapted to be mounted on a vehicle top or other suitable elevated surface. The assembly includes a pair of rigid base sections hingedly secured together and foldable to define a container in which the remainder of the tent can be stored, and unfoldable to define a planar platform a portion of which extends outwardly from the vehicle top or other elevated surface and on which a flexible cover and frame members can be supported to provide accommodations. A support member having a pair of upright legs, a plurality of cross bars and a pair of rigid extenders rotatably mounted on the upper ends of the legs is provided for bracing the outwardly extending portion of the platform. The extenders are rotatable between a folded position, in which the extenders are substantially parallel to the cross bars and in which the support member can be stored on top of the folded tent and within the confines of the separate travel cover; and a bracing position in which the extenders engage the platform. In the bracing position, the support member upholds the outwardly extending portion of the platform and serves as a ladder, providing access to the interior of the tent.

13 Claims, 4 Drawing Figures

CAR TOP FOLDING TENT

BACKGROUND OF THE INVENTION

The present invention relates to foldable car top tent facilities of the type shown in U.S. Pat. No. 4,271,856, invented by the inventor of the present invention. In particular, the invention relates to tent facilities which can be folded into a compact unit and transported on car tops or the like and can be unfolded to provide a planar platform on which an occupant can repose.

Space restraints and user comfort make it desirable to provide a tent assembly which unfolds to a position wherein a portion of the platform extends outwardly from the car top. In this position, however, there may be a lack of support under the outwardly extending portion of the platform. Conventional supports such as poles extending between the platform and the ground are inadequate, since the height of most cars makes it necessary to use poles of such length that they cannot be stored within the folded unit.

Another problem encountered with conventional car top tent facilities is that it is often difficult to gain access to the interior of the unfolded tent. This is ordinarily accomplished by climbing on the vehicle, which can cause physical damage to the vehicle and to the user of the tent.

It is an object of the present invention,, therefore, to provide an improved tent facility for car tops and the like which provides adequate support for portions of the tent platform extending outwardly from the car top and facilitates user access to the interior of the tent.

SUMMARY OF THE INVENTION

The present invention provides an improved folding tent assembly which unfolds to a position wherein a portion of the tent platform extends outwardly from the vehicle top or other elevated surface. A support member is provided which extends between the ground and the overhanging portion of the tent to thereby brace the tent platform against downwardly directed forces.

The support member comprises a pair of upright legs, a plurality of crossbars extending between the legs and a pair of rigid extenders which are pivotally secured to the upper portions of the upright legs. The extenders are movable between a folded position in which they lie across the top surfaces of the upright legs and a bracing position in which they extend upwardly into attaching relation with the overhanging portion of the tent platform. When the extenders are in the bracing position and secured to the tent platform, the platform is undergirded sufficiently to support the weight of the tent and its occupant. In this position, also, users can gain access to the inside of the unfolded tent by stepping on the crossbars of the support member and thus using the support member as a ladder. When the extenders are in the folded position, the support member is compact enough to be stored within the confines of the folded tent assembly.

The support member can be secured to the tent platform in a variety of ways. In a preferred embodiment, the platform is provided at its outer edge with a pair of spaced brackets each having an opening formed therein. The extenders are provided with similar openings so as to receive conventional bolt assemblies and thereby secure the extenders to the brackets. Openings can be provided at various positions along the length of each extender so that the support member is adaptable for use with vehicles of various heights.

Another feature of this invention is an improved construction of the extenders which ensures stability of the support member in the bracing position. Each extender has an L-shaped cross section and comprises a pair of elongated bars fixed at right angles relative to each other. When the extender is in the bracing position, one of the bars abuts the upright leg to which the extender is attached and thereby prevents further rotation of the extender. When the extender is in the folded position, the bar abuts the top surface of the upright leg. The abutment of extenders and legs thus serves to maintain the extenders in their folded and bracing positions.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Figure 1:
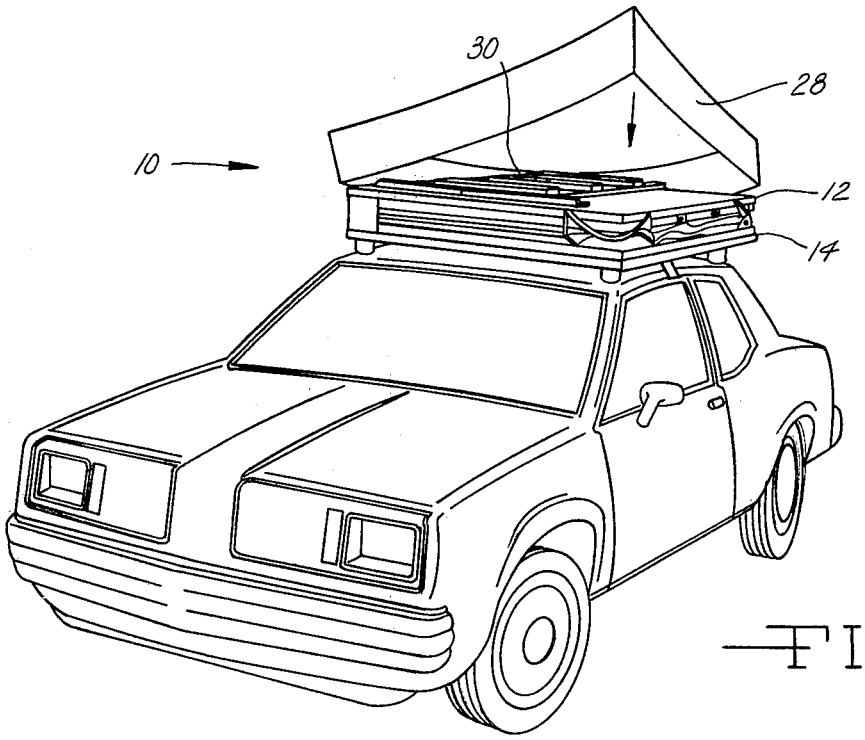
FIG. 1 is a perspective view of the folding tent assembly of this invention, showing the tent and the support member in their folded positions for storage and transport on top of a motor vehicle.
Figure 2:
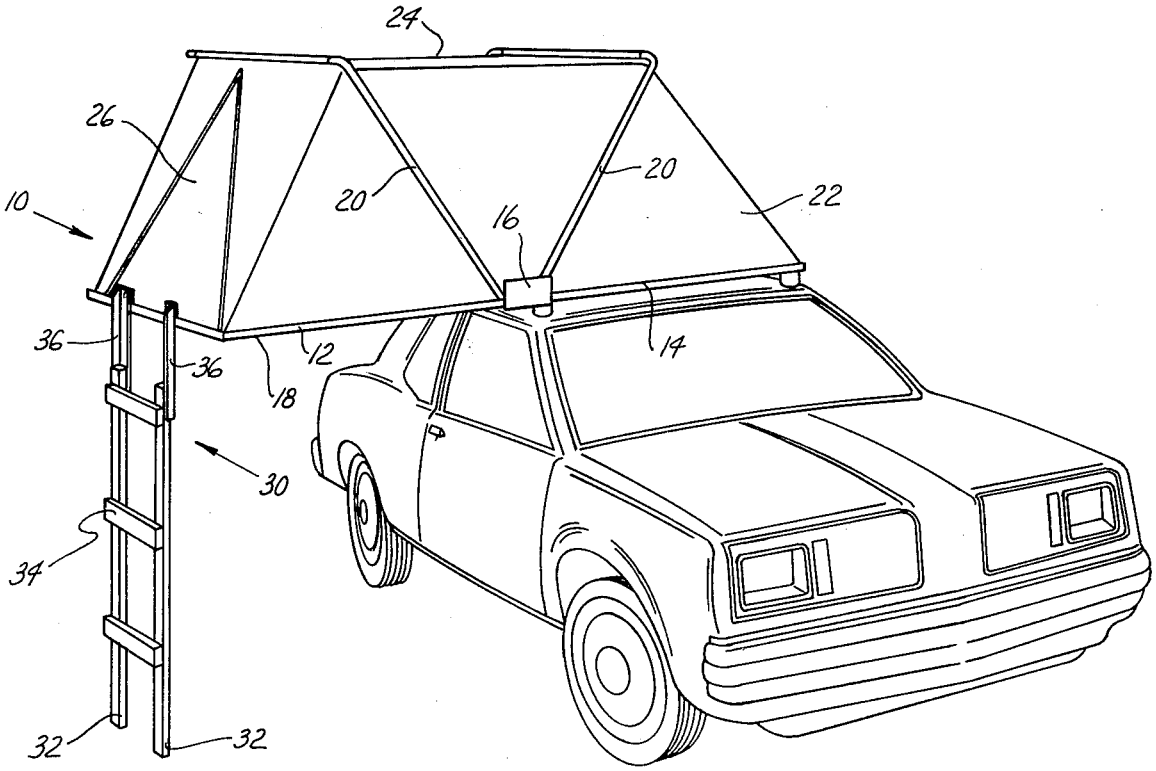
FIG. 2 is a perspective view of the folding tent assembly of this invention showing the tent unfolded and extending outwardly from the vehicle and further showing the support member in its bracing position.

With reference to the drawings, the folding tent assembly of this invention, indicated generally at 10, is adapted to be mounted on a vehicle top and is so depicted in FIGS. 1 and 2. The invention will hereinafter be described in detail solely with reference to its being mounted on a vehicle top. It is to be understood, however, that the folding tent assembly can be mounted on other suitable elevated surfaces. It is to be similarly understood that the invention is not limited to the details of construction and arrangement of parts illustrated in the drawings and described herein, since the invention is capable of other embodiments and of being used in various ways.

As seen in FIG. 2, the folding tent assembly 10 includes a first rigid base section 12 and a second rigid base section 14, which are hingedly secured together at hinge pins 16. The base sections are foldable together with the first base section 12 nested in the second base section 14 so as to define a container as shown in FIG. 1. The length and width of the container, and thus of the base sections 12 and 14, are limited by the dimensions of the vehicle top. The base sections are unfoldable into aligned relation to define a planar platform 18, a portion of which extends outwardly from the vehicle top.

The tent assembly 10 further includes a pair of frame members 20 hingedly mounted on the base sections. A flexible tent cover 22 is secured to the base sections and to the frame members so that when the base sections are unfolded, the cover 22 is drawn into bowed form and defines an enclosure 24. An opening 26 is provided in the enclosure 24 at the end thereof associated with the first base section 12. The opening 26 provides user access to the interior of the tent, and is coverable by suitable conventional means such as a zippered flap. The dimensions of the frame members 20 and the tent cover 22 are such as to permit their enclosure within the container defined by the folded base sections, as seen in FIG. 1. When the tent assembly is so folded, a separate cover 28 may be fitted over the closed container to protect the contents thereof during storage and transportation and hold the tent parts in position.

Figure 3:
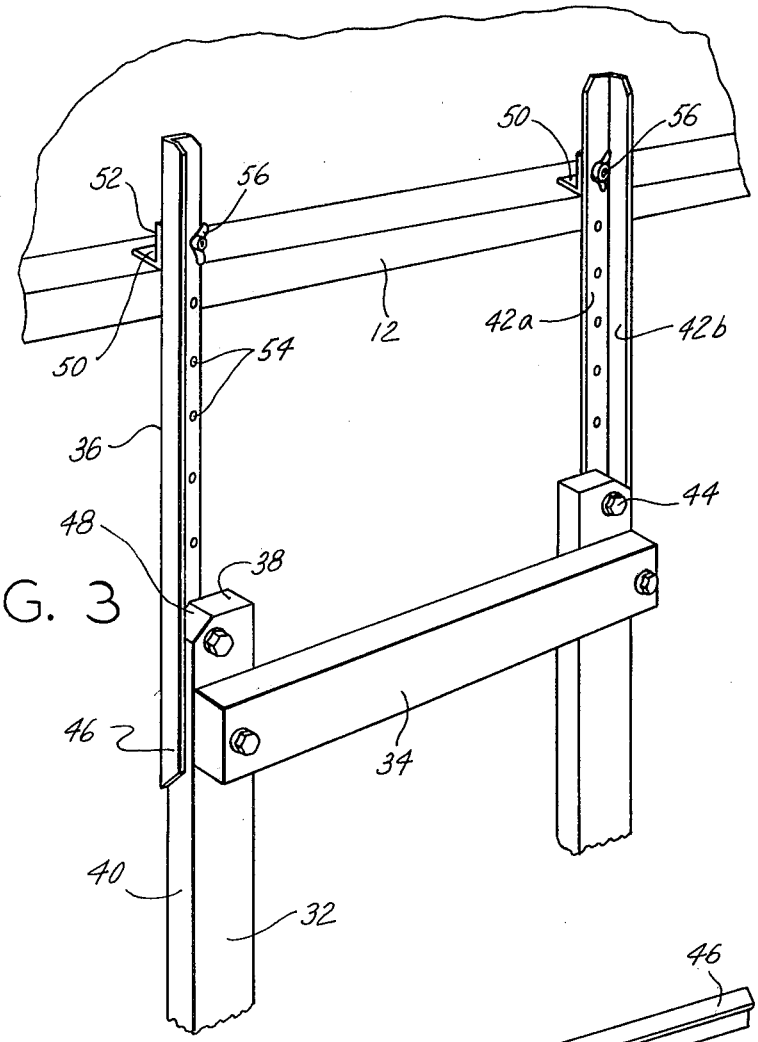
FIG. 3 is an enlarged fragmentary perspective view of the support member in its bracing position.

The invention further provides a support member 30 which is operable to brace the cantilevered portion of the platform 18 and to facilitate user access to the interior of the tent. The support member 30 comprises a pair of parallel upright legs 32, a plurality of spaced cross bars 34 extending between the legs 32 and a pair of rigid extenders 36 which are rotatably mounted at the upper ends of the upright legs 32. As seen in FIG. 3, each of the upright legs 32 has a top surface 38 and an outside surface 40. Each extender 36 has an L-shaped cross section and consists of two flat elongated bars 42 fixed at right angles relative to each other. One of the bars 42, indicated at 42*a*, is pivotally secured to one of the legs 32 for rotation about a pin 44. The other bar 42, indicated at 42*b*, has a lower end portion 46 which coacts with the leg 32 to stabilize the support member, as will be explained more fully hereinafter.

Figure 4:
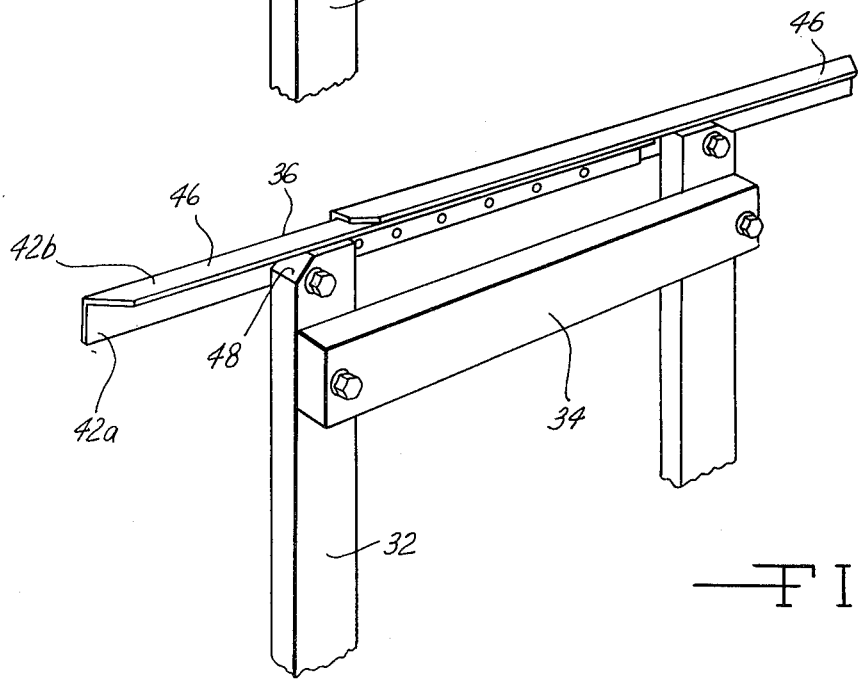
FIG. 4 is an enlarged fragmentary perspective view of the support member in its folded position.

The extenders 36 are rotatable about the pins 44 between a bracing position, in which they extend upwardly and substantially parallel to the legs 32 (FIG. 3), and a folded position in which the extenders extend substantially perpendicular to and lie across the top surfaces 38 of, the legs 32 (FIG. 4). Each of the upright legs 32 is bevelled at the edge where the top surface 38 and the outside surface 40 meet, as indicated at 48 in FIGS. 3 and 4. The bevelled edges 48 allow unimpeded movement of the extenders 36 between their folded and bracing positions.

When the extenders 36 are in the folded position, the overall length of the support member 30 is essentially equal to the length of the legs 32. The length of the legs 32 is determined by the dimensions of the base sections 12 and 14 and the dimensions of the vehicle top. That is, the legs 32 are short enough so that the folded support member 30 does not exceed the dimensions of the container defined by the folded base sections. The support member 30 can thus be stored and transported either inside the container or on top of the container and under the protective cover 28 as seen in FIG. 1.

The extenders 36 are of sufficient length to span the difference between the length of the legs 32 and the height of the vehicle. As seen in FIG. 3, a pair of brackets 50, each having an opening 52 formed therein, are provided at the outer edge of the base section 12. Coacting openings 54 are provided in the extender bars 42*a*. When the extenders 36 are in the bracing position, the openings 54 become aligned with the openings 52 so as to receive bolt assemblies 56 which secure the extenders 36 to the base section 12. A plurality of openings 54 are provided along the length of each extender bar 42*a* to make the support member 30 and the tent assembly 10 adaptable for use with vehicles of various sizes.

When the extenders 36 are in the bracing position (FIG. 3), the lower end portion 46 of each extender bar 42*b* contacts the outside surface 40 of the upright leg 32 to which the extender 36 is attached. This prevents further rotation of the extender past the bracing position and therefore serves to stabilize the support member 30. The two extenders 36 are rotatable in opposite directions. For example, in FIGS. 3 and 4, the extender 36 on the left is rotated clockwise from the bracing position to the folded position while the extender 36 on the right is rotated counterclockwise. This independence of motion, combined with the abutment of the portions 46 against the legs 32, ensures the stability of the support member 30 despite disturbances in the forces to which it is exposed.

In normal use of the folding tent assembly of this invention, the tent assembly 10 is stored and transported in a compact unit on top of a motor vehicle, as seen in FIG. 1. When it is desired to use the tent assembly for accomodations, the protective cover 28 is first removed, the support member 30 is temporarily set aside, and the tent is unfolded by rotating the base section 12 from its position in FIG. 1 to its position in FIG. 2. The support member 30 is then secured to the base section 12 by moving the extenders 36 to the bracing position, aligning the openings 52 and 54, and inserting the bolt assemblies 56. The user gains access to the interior of the tent by climbing up the cross bars 34 of the support member 30, and once inside the enclosure 25 is adequately supported on the platform 18. To restore the assembly 10 to the stored position of FIG. 1, the user removes the bolt assemblies 56, folds the base section 12 back on the base section 14, places the folded support member 30 on top of the base section 12 and replaces the protective cover 28.

The invention thus provides an improved folding tent assembly 10 in which the tent is supported by an improved support member 30 which also serves as a ladder to provide access to the interior of the tent. Improved construction of the support member 30 ensures its stability while bracing the tent platform and enables it to be folded and stored in a compact unit with the folded tent. The folding tent assembly 10 and the support member 30 are easily assembled and disassembled in a short period of time and provide firm, sturdy support for tent occupants.

It is claimed:

1. In a folding tent adapted to be mounted on a vehicle top or on other suitable elevated surfaces wherein a portion of the tent base extends outwardly from the vehicle top or other elevated surface when said tent is unfolded, a support member for bracing said outwardly extending portion comprising a pair of upright legs, each of said legs having a length substantially less than the length of the folded tent, a plurality of spaced cross bars secured to said legs and extending therebetween, and a pair of rigid extenders pivotally mounted on said upright legs for movement between a folded position, wherein said extenders extend substantially parallel to said cross bars, and a bracing position in which said extenders extend substantially parallel to said upright legs and engage the outwardly extending portion of the unfolded tent.

2. In a folding tent, the support member according to claim 1 and further including abutment means on each of said extenders operable upon movement of said extenders to said bracing position to engage said upright legs and thereby maintain said extenders in said bracing position.

3. In a folding tent, the support member according to claim 2, wherein said extenders have substantially L-shaped cross sections.

4. In a folding tent, the support member according to claim 3, wherein each of said extenders comprises a pair of substantially flat bars fixed at right angles relative to each other, one of said bars being rotatably fixed to one of said upright legs and the other of said bars having an end portion which contacts one side of said leg in said bracing position and contacts the top of said leg in said folded position.

5. In a folding tent, the support member according to claim 4, wherein each of said upright legs is bevelled at the edges where surfaces contacted by said extender other bar end portion meet.

6. In a folding tent, the support member according to claim 2, wherein one of said extenders is rotatable from said folded position to said bracing position in one direction and the other of said extenders is rotatable from said folded position to said bracing position in the opposite direction.

7. In a folding tent, the support member according to claim 1, wherein each of said extenders is adapted to engage the outwardly extending portion of the unfolded tent at various positions along the length of said extender.

8. A folding tent adapted to be mounted on a vehicle top or on other suitable elevated surfaces comprising first and second rigid base sections hingedly secured together and foldable together with the first base section nested in the second base section so as to define a container and unfoldable into aligned relation to define a planar platform a portion of which extends outwardly from said vehicle top or other elevated surface, a flexible cover defining an enclosure when fully distended, a plurality of frame members hingedly mounted on said rigid base sections and attachable to said cover so that when said base sections are folded said cover and said frame members are confined within the container defined by the base sections and when said base sections are unfolded said cover is drawn into bowed form, and a support member having a lower end portion adapted to be supported on the ground or on other suitable supporting surfaces and an upper end portion adapted to engage the outwardly extending portion of said unfolded platform, said support member comprising a pair of upright legs, each of said legs having dimensions less than the dimensions of the container defined by the folded base sections, a plurality of spaced cross bars secured to said legs and extending therebetween and a pair of rigid extenders pivotally mounted on said upright legs for movement between a folded position in which said extenders are folded across the top of said legs and a bracing position in which said extenders extend substantially parallel to said legs and engage the outwardly extending portion of said unfolded platform.

9. The folding tent according to claim 8 and further including abutment means on each of said extenders operable upon movement of said extenders to said bracing position to engage said upright legs and thereby maintain said extenders in said bracing position.

10. The folding tent according to claim 8, wherein said extenders have substantially L-shaped cross sections.

11. The folding tent according to claim 8 and further including coacting engagement means on said extenders and on said outwardly extending portion of said unfolded platform.

12. The folding tent according to claim 11 wherein said coacting engagement means comprises a pair of spaced brackets secured to said outwardly extending portion of said unfolded platform, an opening in each of said brackets and an opening in each of said extenders, said openings in said brackets and said extenders being alignable so as to receive bolt assemblies to thereby secure said extenders to said brackets.

13. The folding tent according to claim 12 and further including a plurality of spaced openings provided in each extender along the length thereof, said openings being alignable with said bracket openings.

* * * * *